United States Patent [19]

Fourne

[11] Patent Number: 4,943,220

[45] Date of Patent: Jul. 24, 1990

[54] APPARATUS FOR COOLING MELT SPUN FILAMENT BUNDLES

[75] Inventor: Franz Fourne, Alfter-Impekoven, Fed. Rep. of Germany

[73] Assignee: Fourne Maschinenbau GmbH, Bonn, Fed. Rep. of Germany

[21] Appl. No.: 724,560

[22] Filed: Apr. 18, 1985

[30] Foreign Application Priority Data

Apr. 18, 1984 [DE] Fed. Rep. of Germany ..... 3414602

[51] Int. Cl.[5] ..... D01D 5/092

[52] U.S. Cl. ..... 425/66; 425/72.2; 264/210.8; 264/211.14

[58] Field of Search ..... 425/72.2, 72.1, 182, 425/186, 190, 66

[56] References Cited

U.S. PATENT DOCUMENTS 3,551,949 1/1971 Leybourne, III et al. ..... 425/72.2

4,492,557 1/1985 Ray et al. ..... 425/72.2

*Primary Examiner*—Hubert C. Lorin

*Attorney, Agent, or Firm*—Edward S. Irons

[57] ABSTRACT

An apparatus for cooling melt spun filament bundles by controlled positioning of walls or air stream limiting wings in the quench chamber.

13 Claims, 4 Drawing Sheets

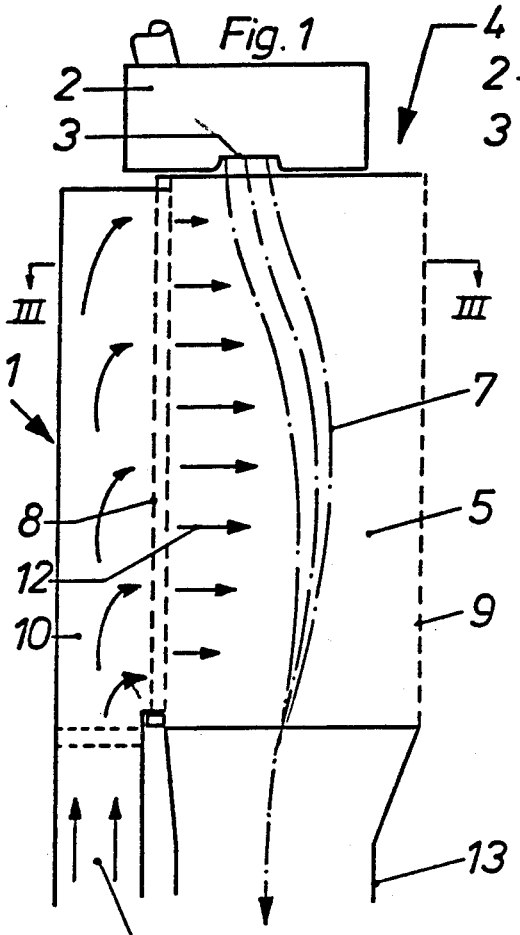
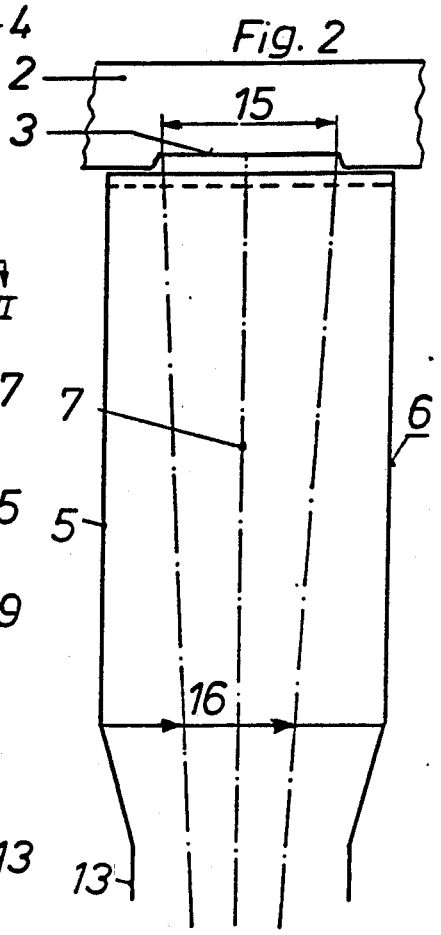
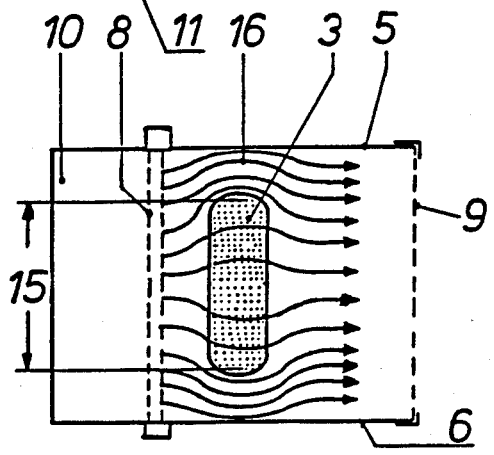
Fig. 3

APPARATUS FOR COOLING MELT SPUN FILAMENT BUNDLES

BACKGROUND OF THE INVENTION

This invention relates to a process for guiding quench air into a quench chamber to cool and solidify filaments and filament bundles. It also relates to quench chambers in which quench air is mainly blown perpendicular to the average thread path axis. Air quenching of melt spun filaments by passing air across the filament bundle is well-known. It is also known that this air stream should be laminar, and that the air velocity profile in vertical direction (thread path direction) can vary according to the particular process. However, the horizontal air velocity profile should be constant. The quench chamber normally has two side walls which serve both to prevent the cross-flowing air from escaping into the factory room and to avoid disturbance of the uniform conditions inside the quench cabinet caused by drafts in surrounding room. For this purpose, the front wall of the cooling duct is made air permeable. The threads or thread bundles are drawn into a floor interconnection tube where they are again protected against outside air influences. This protection is necessary to avoid thread oscillations which can influence the sensitive upper portion of the filaments much as occurs with waves on an oscillating string.

Normally, the filament bundle in the quench chamber forms a certain air resistance system, in which a large part of the air follows the path of least resistance and passes outside of the filament bundle. This bypassing air is not available for air quenching itself, since it does not pass by the bundle closely enough to have a cooling effect. In addition, the boundary zone near the wall channels and accelerates the evading flow creating a speed gradient running perpendicular to the flow direction which causes a transition into turbulence and leads to strong fluttering of the outer filaments of the bundle.

For the usual practice of supplying the quench chamber from an air supply entrance through an air supply box and rectifier to the vicinity of the filament bundle, the air flow boundary layer thickness increases along the wall by the square root of the running length of the air, usually reaching values of between 20 and 40 mm. (See L. Prandtl, "Fluid Dynamics", 4th edition 1944, page 99, FIG. 91).

The objective of this invention to influence the course of cooling of the filaments or filament bundle in the quench duct in such a way that the filaments are cooled equally over the entire width and height of the quench duct. It is a further object that the cross-running cooling air is not forced to significantly deviate from its flow path through the filaments. According to this invention, a relatively small free-flow space is formed for the cooling air stream between the outer side of the filament bundle and the quench duct limiting walls. The width of this free-flow space corresponds to the distance between the single filaments of a filament row and is usually between 10 to 15 mm, with a maximum of 25 mm. For this purpose, intermediate limiting walls or wings at the sides of the quench chamber are set at the aforementioned distance from the outer filaments of the filament bundle.

By setting the side limiting walls of the quench duct closer to the outer filaments of the filament bundle, the cooling air can no longer freely pass between the outer filaments and the walls. Instead, it is forced to find its way between the single filaments of the bundle itself. Therefore, the flow of the air becomes more evenly distributed, and the cooling effect is considerably improved. By eliminating the formation of a side stream, there is an essential improvement in the efficiency of the cooling process, since the threads cool more rapidly. Because variations exist in the kind of polymer being spun into filaments and in the melt temperature, it will not always be possible to use the same distance to the sidewalls as between the filament rows. This is because the melt spun filaments can be sticky at points between the spinneret and where the polymer solidifies, causing the process to stop if an oscillating filament should touch the side wall. Thus there are optimum distances between the filaments in the bundle and between the outer filaments and the intermediate limiting side walls. Distances of about 10–25 mm, depending on width of the filament bundle, usually provide adequately safe and uniform flow through the filament bundle.

It should be remembered that the distance between the outer filaments and the limiting walls of the quench duct remains constant along the entire vertical height of the air supply from the rectifier to the filament, thus providing optimum conditions along the entire filament bundle.

An additional improvement of this invention is the inner air guiding wings located inside of the outer quench chamber walls. These wings are kept at a constant distance form the outermost threads of the filament bundle. Preferably the angle followed by the inner air limitation wings is the same as that of the contractable path of the thread bundle. Specifically, the inner wings should be inclined downwardly towards the vertical center line of the quench chamber, thus converging at the bottom. Thus, the chamber's horizontal cross section can be kept retangular. The separate inner air limiting wings allow the optimum conditions of each operation to be adjusted and set so that a uniform air flow always passes through the bundle. This optimization is also possible where several multifilaments with parallel vertical center lines or with slightly downwards convergent center lines are to be cooled and solidified.

Similar conditions can be arranged at the supply side of the air rectifier and quench chamber by arranging air stream wings in the plenum which are in alignment with the air stream limiting wings of the quench chamber.

This invention can also be used in cases where threads are drawn upwards from the spinnerets. In such cases the above-mentioned air limiting wings at the air supply side and in the quench chamber provide the same advantageous conditions for upward drawing as for the corresponding downward drawing systems.

DESCRIPTION OF THE DRAWINGS

FIGS. 1, 2 and 3 explain the basic design of an air quench chamber with a side cross section view, a front view, and a top view, respectively, in which no side limiting walls or wings are spaced relative to the filament bundle.

Figure 4:
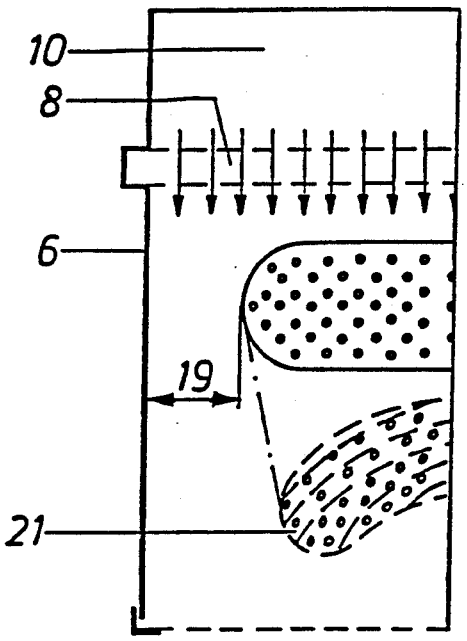
FIG. 4 shows top view of the quench cabinet of FIGS. 1–3, with a relatively large distance between outer filaments and side wall.

According to FIGS. 1–3, the air quench unit 1 below the spinnning head 2 with spinnerets 3 consists of a plenum chamber 10 and a quench housing 4 with fixed side walls 5 and 6, and an air stream rectifier 8 standing parallel to the vertical center line of the filament bundle 7. This unit provides a cross-flowing air stream through an air permeable front door 9. The air passing through the air stream rectifier 8 comes from the plenum chamber 10, which is fed by supply air 11. The rectifier 8 directs the air stream 12 perpendicular to the filaments 7. The cooled and solidified threads move downwards through a floor interconnection tube 13 where they are protected from outside influences.

One or several filament bundles, each having a width 15 equal to the distance between the outer holes of the spinneret, are normally guided together to one take-up point which can be formed by a thread guide, a finish oil application pin, or a godet, thus the width of each thread bundle is reduced below the spinneret downwards to a very small point. It is comtemplated that in some instance the thread bundle will remain parallel, so that upper and lower regions are of equal width.

FIG. 3 shows a stream line diagram 16 in which a substantial portion of the cooling air can pass outside the filament bundle 7, because the bundle has a higher air resistance than the open outer space. Thus, an uneven cooling effect results. The cooling is also affected by the boundary layer, located near the side walls which influences the cooling of the outer filaments so that the cooling effect becomes more uneven.

Figure 5:
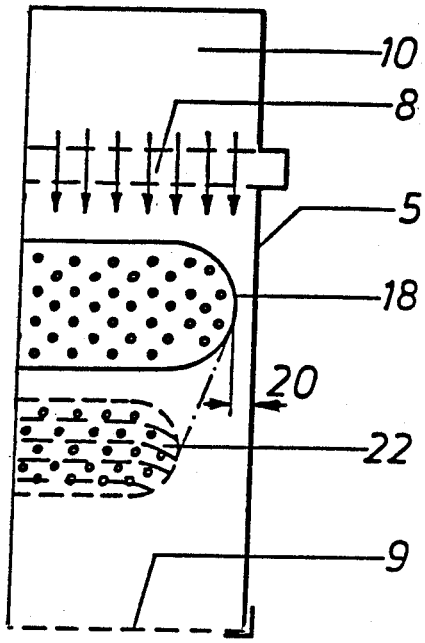
FIG. 5 shows a similar cross section with a smaller distance between the outer filament and the side wall.

The FIGS. 4 and 5 show the spinneret hole pattern 18 beside a cross section of the down-running filiment bundle 22, approximately 1 m below the spinneret. As is clearly shown, the filament bundle is displaced in the air stream direction by the air resistance of the filaments 21. In FIG. 4 a large distance 19 is shown between the outer filament of the spinneret 18 and the side wall 6, while in FIG. 5, the distance 20 is substantially smaller. In the arrangement shown in FIG. 4, the thread bundle 1 m below the spinneret shows a large deformation caused by the higher air velocity near the outer filament and the curvature of isothermal lines 21. The isothermal lines through the filament bundle 21 are not uniformly distributed, so that the middle rear side of the filament bundle has the highest temperature, and the outer front edge has the lowest temperature. By comparison, FIG. 5 shows that the displacement of the filament is uniform and that the isothermal lines through the filament bundle are almost straight when there is a small distance 20 between the wall and the filament bundle. The narrow distance results in a much more uniform air quenching and better filament cooling.

Since most of the filaments converge as they run downwards, it is advantageous to guide the two air stream limitation wings in the quench chamber in that same direction so that they run nearly parallel to the outer filaments of the filament bundle. This serves to reduce both the boundary layer thickness and the distance between the outer filaments and the side walls.

Figure 6:
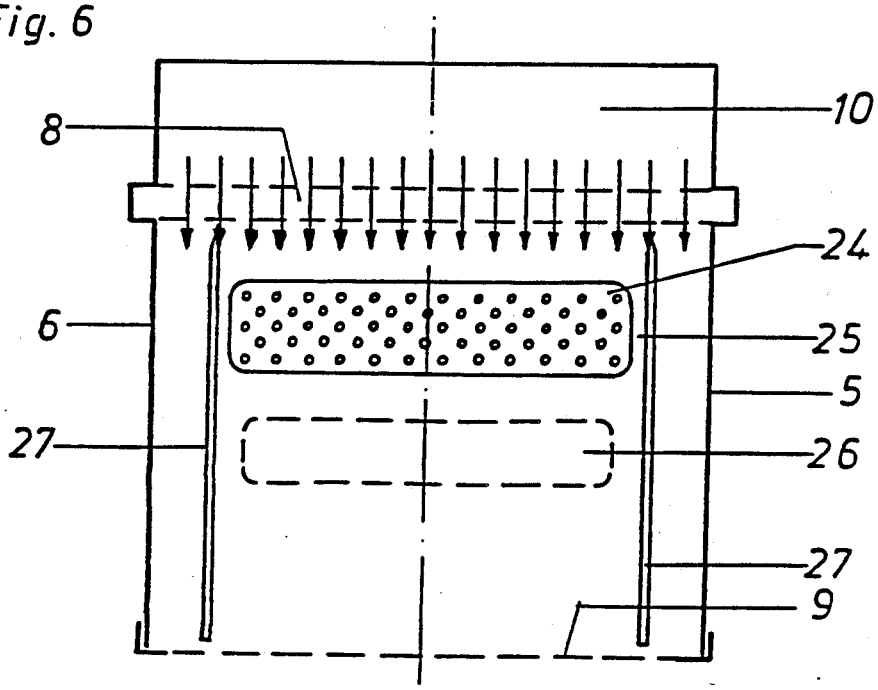
FIG. 6 is a top view of a horizontal cross section through a quench chamber as in FIG. 5 but in addition showing the additional side limiting wings or walls running parallel to the outer filaments of the bundle.

FIG. 6 shows this arrangement for a rectangular filament bundle 24, whereby the filament bundle cross section 26, located 1 m below the spinneret, 25 is displaced by the cross-flowing air when the intermediate air stream is guided by limiting wings 27. Since flow distance of the air stream along these wings is usually in the range of only 50 to 200 mm, the boundary layer will be only a few mm thick, and thus have almost no influence on the air passing through the thread bundle. The temperature increase of the cooling air is due only to the temperature of the air passing through the filaments.

The air between the limitation wings and the outer walls 5 and 6 of the quench chamber has no influence on the filament cooling and cannot influence the properties of the finished filaments.

Figure 8:
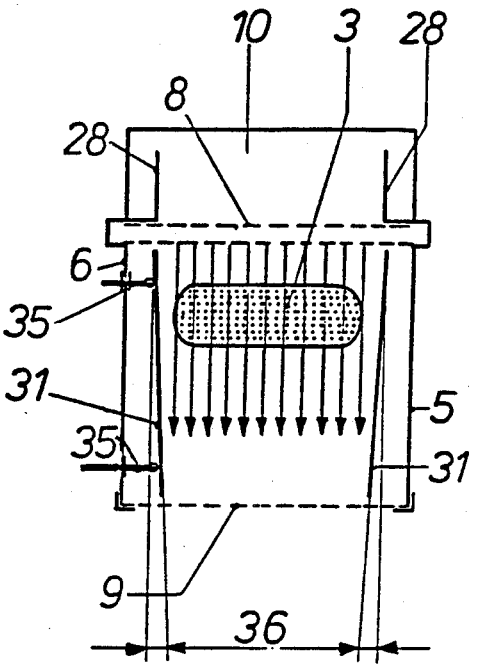
FIG. 8 is a top view showing the air supply side air stream limitation walls and also the quench chamber air stream limiting walls or wings converging toward each other in the air stream direction.

The quantity of air lost between the inner limitation walls and the outer wings can be compensated for by installing air stream limitation walls on the air supply side of the rectifier shown as angled wings 28 in FIG. 8 and by closing the outer part of the rectifier. When the outer part of the air rectifier is closed it is possible that the supply air could be accelerated along the air stream limitation walls parallel to air flow, resulting in higher velocity outer air streams in the quench chamber. This can be avoided by arranging in the plenum, air guiding or limiting walls 28, which are 50 mm or more in length, in exact alignment with the air limitation wings of the quench chamber. Any length of more than 50 mm at the supply side will be advantageous, but since the thickness of the boundary layer increases with the square root of the running length, lengths of more than 200 mm produce boundary layers large enough to create problems.

Figure 7:
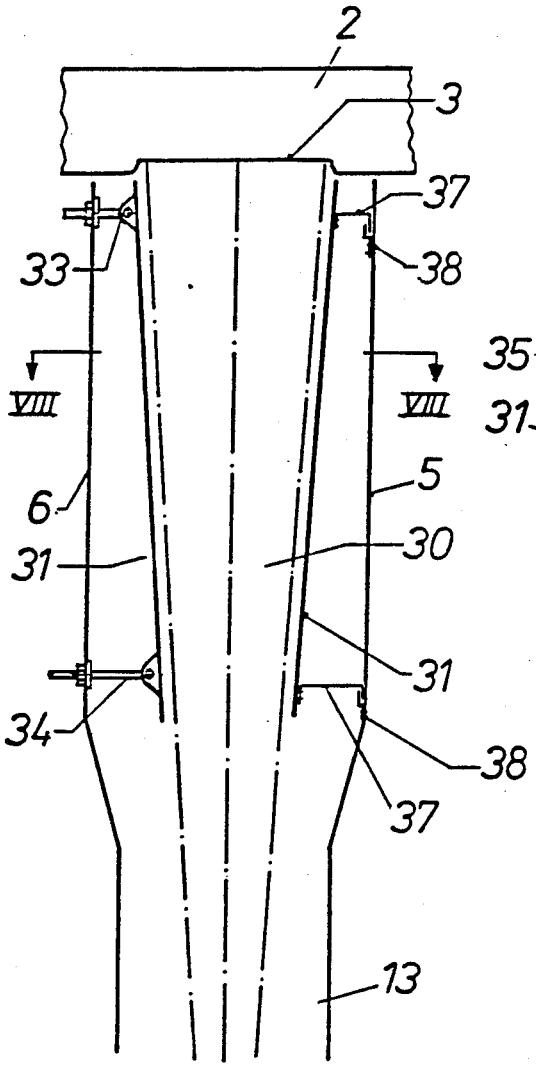
FIG. 7 is a front view of the quench chamber showing the additional side limiting wings running parallel to the outer filaments of the bundle.

As already mentioned, the filament bundle can converge toward a single point at the bottom of the quench chamber. In order to obtain superior cooling conditions along the entire path of the thread bundle, the inner air stream limiting wings 31 can be arranged in parallel with the outer filaments of the bundle 30 as shown in FIG. 7. That means, for example, in cases where the distance between outer filaments and air limiting wings 31 is 15 mm at the upper part of the bundle, then that distance should remain constant along the entire downward thread path. In some cases the distance may even become slightly smaller toward the bottom of the quench chamber, as the width of the filament also becomes smaller. Perferably, the air stream limitating wings should follow the path of the outer filaments to the vertical point where the filament bundle is guided together. When employed, the corresponding air limiting wings in the plenum should preferably have the same alignment as the inner air stream limiting wings.

Another effect that should be minimized is a post-filament disturbance in the cooling air. The filament bundle causes a certain air stream resistance with corresponding displacement currents which try to reconverge behind the filament bundle. Thus, the air stream behind the filament bundle can become, in certain zones, divergent and unstable as the Reynold's number becomes excessive, ultimately leading to a turbulent air stream. This turbulence can result in poor filament properties.

This effect can be ameliorated by arranging the air limiting wings or walls so that they converge slightly in the air stream direction. This serves to counterbalance the divergence effect on the air stream caused by the resistance of the filament bundle. At the same time, this gives more laminar character to the air stream and a more uniform cooling effect to the filaments.

In order to avoid difficulties, such as having the starting melt drop onto the sloped walls as a result of the slope of the convergent air stream limiting wings in either the vertical or horizontal direction, the air limitation wings can be hinged a short distance below the spinning head by hinges 33 in FIG. 7 or 35 in FIG. 8. These hinges can be adjusted downwards by eye-screws 34 with bayonet type fixing holes in the outer walls. It may be advantageous to provide all these connections with screws in order to adjust the distances between the inner wings and outer filaments, but in other circumstances it may be preferable to have them replaced with fixed distance pieces 37 shown in FIG. 7. For purposes of cleaning and/or exchanging the rectifiers, it will be advantageous to have gliding rails in order to pull out the inner limitation wings.

The following example may explain some details, but it is not intended to limit the scope of the invention in any way.

EXAMPLE I

In a process for spinning a polyester tow for staple fiber production, the hole pattern of the spinneret should have a width of 400 mm and a depth of 80 mm. At 1.60 m below the spinneret, the filiament bundle has a 300 mm width, and a depth in air stream direction of about 60 mm. The quench zone has an inner width of, for example, 480 mm at the vertical side walls. The distance between the outer filaments and the side walls will be 40 mm at the top of the chamber, and 90 mm at 1.60 mm below the spinnerets. Thus a substantial proportion of the cooling air should pass beside the filament bundle, with a greater quantity of non-cooling air flowing through the side paths at 1.60 m below the spinnerets. In order to avoid this problem, two air stream limiting wings should be installed, so that the inner width can be tailored to, for example, 440 millimeters at the top of the chamber and 340 mm at a point 1.60 m down from the top of the quench chamber. The distance at the top of the chamber allows 400 millimeters for the thread bundle and two 20 millimeter free distances for the space between the limiting wings and the filaments. The distance at the bottom of the chamber allows 300 millimeters for the thread bundles and the same two 20 millimeter free distances. When the air stream limiting wings converge in air stream direction, the air outlet side of the wings should have a width of 420 mm at the top of the chamber and a width of only 320 mm at a point 1.60 m lower. In a test run, the cooling effect of this arrangement will be much better than when an air quench cabinet without these inner air stream limitation wings is used. Since the action of the filaments will become much more stable.

When the plenum 11 at the air supply side of the rectifier is much wider than the reduced air quench space, two correspondingly designed angle sheets or wings can be arranged on the air supply side of the rectifier in order to close the outer space of the rectifier and prevent air from passing through. The length of these angle sheets in the air stream direction should be at least 50 mm and preferably 75 to 100 mm.

Figure 10:
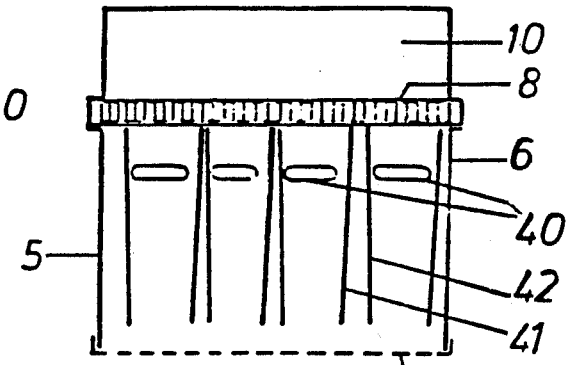
FIGS. 9 and 10 are respectively a front and top view of an air quench chamber which contains four filament bundles in series which are surrounded by air stream limiting walls, and which converge in two directions: downwards and toward the direction of air flow.
Figure 9:
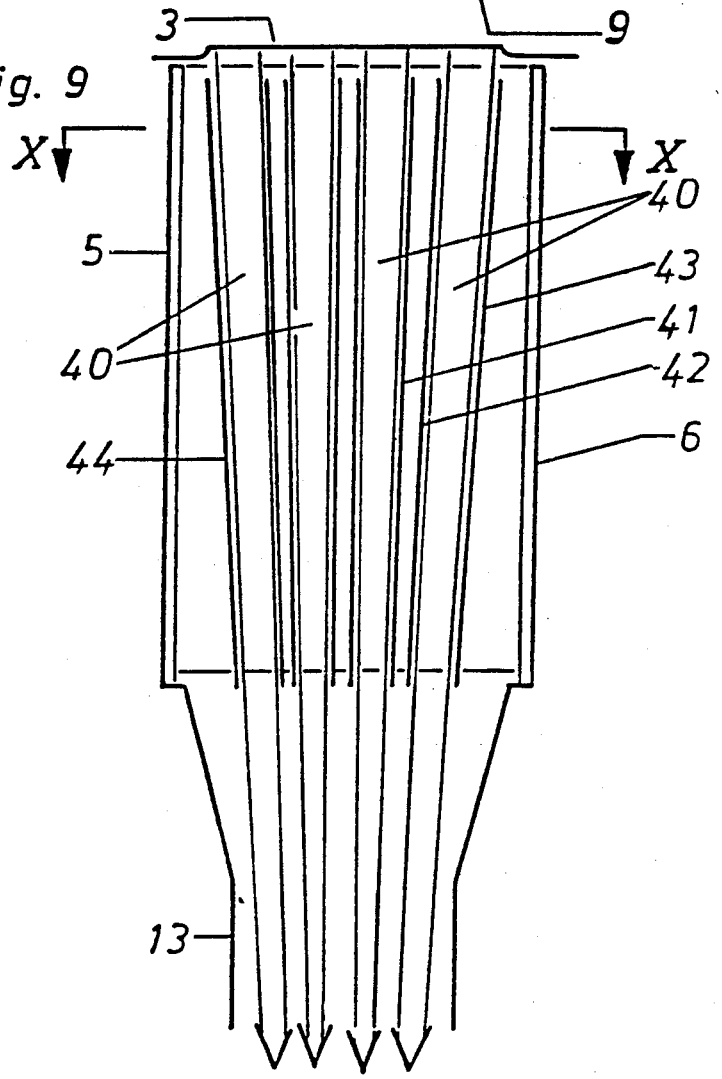

When there are two or more spinnerets above one common quench chamber, structural arrangements can be made to maintain the desired flow effects. It is known that several thread paths can be separated by individual interspersed separation sheets, usually to avoid adjacent thread breaking, i.e., where one breaking filament will cause a neighboring multifilament to break, and cause detrimental effects on the take-up winders. However, such a separation sheet does not fulfill the desired conditions of this invention. FIGS. 9 and 10 show that by using two air stream limitation wings 41 and 42 between every two filament bundles 40, desirable flow conditions can be attained so long as the wings are arranged as mirror images facing both the center line of each filament bundle and the center line of the quench cabinet. Each of the mentioned pairs of air limitation wings is aligned parallel to the neighboring outer filament, and is separated from that filament by the same distance as the corresponding wing on the opposite side of the filament bundle. The horizontal cross-section shows an advantageous arrangements in which limiting wings 41, 42 coverge toward each other. A similar arrangement can be used when spinning by means of 3 or more spinnerets arranged in one line. The convergence angle can be between 2° and 20°, i.e. 1°-10° per side when measuring against the main air stream direction without filaments.

EXAMPLE II

This example describes a device used in spinning and cooling coarse carpet yarn multifilaments. Spinning may be accomplished with, for example, 4 spinnerets, each having a hole pattern of 250×60 mm, and producing filaments which are drawn together about 8 m below spinneret to one point. A quench chamber is of rectangular design, having vertical outer side walls 5 and 6 is used. Additional air stream limitation walls or wings as shown in FIG. 9 are used, each spaced approximately 15 mm away from the outer filament of each bundle.

When the thread path in the cooling zone is to have a length of about 4 m, the air stream limitation wings should follow the filaments downwards for these 4 m, with each pair arranged to converge 20 mm in the air stream direction as shown in FIG. 10.

The individual filaments can enter at the top of the chamber at a melt temperature of 270° C. and be taken up at speeds of more than 4000 m/min. When there are no air stream limiting wings in the quench chamber the filaments order transition point of this polymer, after traveling the same path, thus giving a better quality product.

This comparison shows that a much better cooling effect, and consequently a better quality fiber, can be obtained using air stream limiting wings in the quench chamber. The yarn temperature will reach a temperature of between 65° and 70° C. after travelling 4 m in a cross flow cooling path and an additional 2 m through a floor interconnection tube. When the quench chamber has air stream limitation wings the yarn temperature will drop below 40° C., which is under the second chamber for many filament bundles as well as a single filament bundle.

I claim:

1. Apparatus for cooling and solidifying a melt spun filament bundle, comprising:

a quench chamber having side walls;

a zone defined by the perimeter of a filament bundle to be quenched disposed between said walls;

an air rectifier positioned on one side of said zone and adapted to provide an air stream flowing across said zone;

each of said side walls being spaced at a constant distance of not more than 25 millimeters from the adjacent boundary of said zone and converging in the direction of air flow;

a pressure or plenum chamber located in front of said rectifier; and an air permeable wall positioned on the side of said zone opposite said rectifier.

2. An apparatus as defined by claim 1 in which each of said side walls is spaced at a constant distance of not more than 10 to 15 millimeters from the adjacent boundary of said zone.

3. A quench chamber according to claim 2, including means for drawing filaments leaving the spinnerets upwards.

4. Apparatus for cooling and solidifying a melt spun filament bundle, comprising:

a quench chamber having side walls;

a zone defined by the perimeter of a filament bundle to be quenched disposed between said walls;

inner air stream limiting wings in said chamber between the quench chamber side walls and the adjacent boundaries of said zone;

means for adjustably controlling the position of the wings to maintain the distance between each of said wings and the adjacent boundaries of said zone constant and within a range of from 10–15 millimeters to 25 millimeters;

an air rectifier positioned on one side of said zone and adapted to provide an air stream flowing across said zone;

a pressure or plenum chamber located in front of said rectifier; and an air permeable outlet wall positioned on the side of said zone opposite said rectifier.

5. Apparatus as defined by claim 4 wherein said wings are inclined downward to accommodate contraction in the perimeter of the filament bundle.

6. A quench chamber according to claim 4, wherein more than one parallel filament bundle runs downward in the quench air chamber, and between every two filament bundles are two air stream limiting wings aligned to run parallel to and maintain a constant distance from the perimeter of the adjacent filament bundle.

7. A quench air chamber according to claim 4, wherein the inner air stream limiting wings converge in the air stream direction such that the distance between said wings and said adjacent boundaries of said zone is greatest at the air rectifier side and narrows in the air stream direction toward the air permeable wall.

8. A quench air chamber according to claim 7 wherein each pair of inner air stream limiting wings adjacent to a filament bundle converge between 2° and 20° toward each other with respect to the air flow direction.

9. A quench air chamber according to claim 8 wherein the angle of inclination of the inner air stream limiting wings with respect to the vertical centerline of said chamber can be symetrically adjusted by means of length adjustable distance pieces.

10. A quench air chamber according to claim 9, wherein the length adjustable distance pieces are screw type devices.

11. A quench air chamber according to claim 9, wherein the length adjustable distance pieces are made with constant lengths and are interchangeable.

12. Apparatus for cooling and solidifying a melt spun filament bundle, comprising:

a quench chamber having side walls;

a zone defined by the perimeter of a filament bundle to be quenched disposed between said walls;

an air rectifier positioned on one side of said zone and adapted to provide an air stream flowing across said zone;

inner air stream limiting wings positioned between the boundaries of the zone and the quench chamber side walls, each of said wings being spaced at a constant distance of not more than 10 to 15 millimeters from the adjacent boundary of said zone;

a pressure or plenum chamber located in front of said rectifier;

plenum air stream limiting wings located on the air rectifier side of such chamber, and aligned with said inner wings in such a manner that the flow of air between the said side walls of the quench chamber and said inner air stream limiting wings is prevented; and an air permeable wall positioned on the side of said zone opposite said rectifier.

13. Apparatus for cooling and solidifying a melt spun filament bundle, comprising:

a quench chamber having side walls;

a zone defined by the perimeter of a filament bundle to be quenched disposed between said walls;

an air rectifier positioned on one side of said zone and adapted to provide an air stream flowing across said zone;

inner air stream limiting wings positioned between the boundaries of the zone and the quench chamber side walls, each of said wings being spaced at a constant distance of not more than 10 to 15 millimeters from the adjacent boundary of said zone;

said inner air stream limiting wings being supported on gliding rails which are located in the air stream direction, so that said wings can be displaced in the air stream direction;

a pressure or plenum chamber located in front of said rectifier; and an air permeable wall positioned on the side of said zone opposite said rectifier.

* * * * *